United States Patent [19]

Veron

[11] 3,993,907

[45] Nov. 23, 1976

[54] CAMERA TUBE WITH A PYRO-ELECTRIC TARGET

[75] Inventor: Serge Veron, Paris, France

[73] Assignee: Thomson-CSF, Paris Cedex, France

[22] Filed: Apr. 23, 1975

[21] Appl. No.: 570,840

[30] Foreign Application Priority Data

Apr. 26, 1974 France ..... 74.14637

[52] U.S. Cl. ..... 250/333; 250/330; 313/101

[51] Int. Cl.[2] ..... H01J 31/49

[58] Field of Search ..... 250/330, 333; 313/101

[56] References Cited

UNITED STATES PATENTS

| | | | |
|---|---|---|---|
| 3,123,737 | 3/1964 | Schneeberger | 250/333 X |
| 3,487,212 | 12/1969 | Micheron et al. | 250/330 |
| 3,831,029 | 8/1974 | Jones et al. | 250/333 X |

*Primary Examiner*—Archie R. Borchelt
*Attorney, Agent, or Firm*—Roland Plottel

[57] ABSTRACT

A pyroelectric radiation detector which is relatively immune to the effects of microphonic vibrations includes within an evacuated envelope a triglycine sulphate (TGS) target secured by silicone grease to a thin (3–6 $\mu$M) mica support plate. The mica support plate is adhesively secured by means of an enamel to a titanium annulus which, in turn, is epoxied to the window of the evacuated envelope. The coefficients of expansion of the annulus and the support plate are selected such that after they are joined on to the other the support plate is stretched tightly across the annulus and therefore has a natural period substantially higher than the natural period of the annulus which supports it.

8 Claims, 2 Drawing Figures

CAMERA TUBE WITH A PYRO-ELECTRIC TARGET

BACKGROUND OF THE INVENTION

A. Field of the Invention

The present invention relates to a thermal television camera tube operating in the near-infra-red or far-infra-red range.

B. Discussion of the Prior Art

A tube of this kind is equipped with a pyroelectric target or retina upon which the incident radiation creates a temperature profile, the latter creating an electrical bias profile within the thickness of the target and, consequently, an electrical charge profile which may be read out by an electron-beam scanning the target point by point. The electrical signals obtained during the course of this scanning operation, constitute the image of the object from whence the radiation comes. Tubes of this kind are known in the prior art; it is for this reason that no detailed discussion of the conditions under which they operate will be given, since these conditions are described in particular in U.S. patent application Ser. No. 243,210 (U.S. Pat. No. 3,774,043).

It should be pointed out that a pyroelectric target, for reasons of sensitivity, should be very thin; a thickness in the order of some few tens of microns is normally employed. For example, with a material such as glycocoll sulphate, also known as triglycine sulphate (TGS) which is frequently employed in this kind of application, a frequently used thickness is 25 microns.

For reasons associated with the resolving power, a circular target is customarily employed typically having a diameter of at least 30 mm.

A target of this kind takes the form of a very thin, and therefore extremely fragile, component which must, as far as possible, be protected from the vibrations which it may experience in the tube in which it is mounted. This sensitivity to vibration, quite apart from the threat which it poses to the mechanical integrity of the target, also tends to cause an alteration in the output signal referred to as "microphoning."

SUMMARY OF THE INVENTION

In accordance with the invention, the pyroelectric target or retina is arranged upon a very flat, stretched substrate. The substrate is then applied to the front face of the camera tube in which the scanning beam is generated and the tube exposed by said front face or window, to the incident infra-red radiation.

The invention and its mode of operation will be more fully understood from the following detailed description when taken with the appended drawing in which:

DETAILED DESCRIPTION OF THE INVENTION

Figure 1:
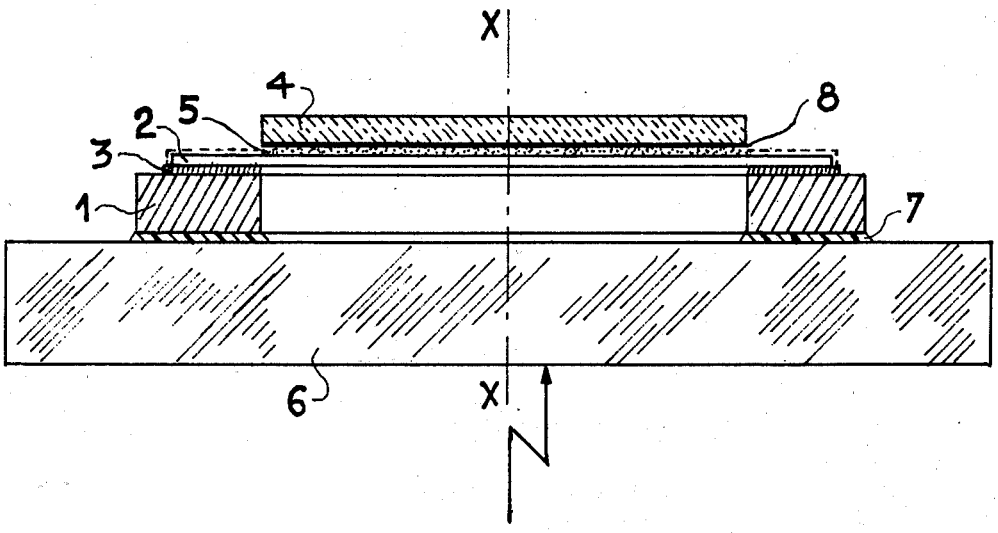
FIG. 1 is a cross-sectional view of an illustrative target assembly according to the invention.

As shown in FIG. 1, to a thick annular ring 1 there is fixed a thin support plate 2. To plate 2, which constitutes the substrate proper, there is subsequently applied a retina 4 as the sectional view of FIG. 2, taken in a plane which is normal to the axis *xx* in FIG. 1, illustrates.

The different conditions to which ring 1 and plate 2 are subjected will become apparent from the ensuing description.

In one embodiment of the invention, annulus 1 is made of metal and support plate 2 of mica, the attachment of the plate to the annulus being carried out, for example, by a hot bonding operation.

The metal of annulus 1 is chosen to have a coefficient of expansion which is substantially less, within certain limits, than that of the mica from which the support plate is made. Accordingly, after the cooling which follows the bonding operation, support plate 2 will be stretched and extremely flat.

The bonding material typically employed is an enamel of the type utilized in vacuum techniques; a ceramic material, such as that known by the trade name of Pyroceram, can also be used for this purpose. Typically, the metal annulus has a thickness of 2 mm and the mica support plate, produced by a cleaving operation, is between 3 and 6 microns in thickness.

The retina 4 is then applied to plate 2 and secured thereto in a cold state, by an adhesive layer 5. The latter is introduced, for example, by applying adhesive drops to the periphery of retina 4, which is in contact with plate 2, the adhesive spreading beneath the retina to form layer 5 by capillary action.

The assembly thus constituted is then secured to the window 6 of the camera tube, which is exposed to the incident radiation illustrated by the broken-line arrow. The fastening of the retina assembly to the face of the camera tube is effected by the use of an adhesive, in the form of an epoxy resin, for example, the layer 7.

The tension established within the body of support plate 2, following the bonding operation, has the effect of increasing the natural frequency of the plate and of moving this frequency away from the much lower, natural frequency of the solid annular ring 1, which is heavy if made of metal as in certain embodiments of the invention. Thus, a sub-assembly is created comprising annulus 1, bonding layer 3, and support plate 2. Because of the two different natural frequencies, this sub-assembly exhibits heavy damping vis-a-vis the vibrations to which it may be exposed in operation. Retina 4, as we have seen, is secured to the sub-assembly by the adhesive layer 5.

The tension resulting from the first bonding operation depends upon the difference between the coefficients of expansion of the materials from which annulus 1 and support plate 2 are made. For any given plate, there is an optimum difference which ensures proper tension in the plate without risk of failure. In the case of a mica plate having the above-indicated thickness, annulus 1 may be made of titanium or a ferro-nickel, the coefficients of expansion of which are around $90\times10^{-7.\circ}\ C^{-1}$.

Plate 2 must have a low thermal capacity, (the product of its mass and specific heat,) in order not to impede the increase in temperature of the retina when the tube is subjected to incident infra-red radiation. The extreme thinness of this plate (only 3–6 $\mu$) contributes to the attainment of this condition. This thinness also limits lateral diffusion of heat within the plate and the loss of definition which would otherwise result.

The adhesive layer 5 used to secure retina 4 to support plate 2 must satisfy the same thermal conditions as the plate 2 itself. It must also ensure proper attachment of the retina to the substrate and must be capable of spreading in a layer of uniform thickness, this being a condition precedent to achieve the aforesaid flatness. The adhesive must also have a low vapor pressure within the range of operating temperatures of the camera tube and should not comprise a "poison", vis-a-vis the cathode.

This adhesive may comprise, for example, of one of the oils or greases used in vacuum technology for their low vapor pressure. The oils or greases known by the trade name of Apiezon are particularly suitable for the purpose, as also are paraffin and silicone oils. The thickness of the adhesive layer is in the order of 5 microns in the present example. It is quite possible, to produce adhesive layers of uniform thickness containing no air bubbles by using the droplet technique previously described. In addition, the products used to produce layer 5, and the Apiezon greases in particular, have a thermal conductivity of between 3 and $5\times10^{-4}$ $Cal.cm^{-1}.s^{-1}{}^{\circ}C^{-1}$ and a specific heat ranging between 0.3 and 0.5 $Cal.g^{-1}.{}^{\circ}C^{-1}$, these values being of the same order as the corresponding values for triglycine or glycocoll sulphate (TGS); the mass of this layer, on the other hand, is much smaller than that of the retina, with the values given above.

No special condition is imposed on either plate 2 or layer 5 as far as their transparency to the infra-red spectrum is concerned. This is due to the fact that they both are very thin, sufficiently so in fact to permit rapid transfer of heat to the retina. Nor is any condition of transparency imposed upon annular ring 1 whose internal diameter (25 mm) is arranged to be slightly larger than that of the retina, the external diameter of the ring being, for example, 30 mm. As far as the material of window 6 is concerned, this may be chosen from the many known materials which have good transparency to infra-red radiation.

In FIG. 1, a dotted line has been used to illustrate the metallization which must be provided at the edge of plate 2 in order to establish an electrical connection between the window of the tube itself, the latter also being metallized, possibly at its periphery (the metallizing has not been shown), and the metallized face of the pyroelectric target or retina; metallizing is illustrated by the thick line 8.

In another embodiment of the invention, plate 2 is made of a plastic material, for example a polyester; in this case, it is possible to reduce its thickness to a smaller value than in the case of mica; polyester plates of $2\mu m$ in thickness have been used.

In the latter example, the attachment of plate 2 to ring 1 is not, of course, carried out by a hot bonding operation, but, rather, by the use of a plastic adhesive. The tension is achieved in this case by arranging for ring 1 to be split into two halves, the gap between which is adjusted at the time of assembly in such a fashion as to achieve the desired tension in plate 2. The remainder of the operations are identical with those specified in the first example described earlier.

In both cases, the structure described substantially inhibits microphoning at all frequencies between some few hertz and some few kilohertz.

Figure 2:
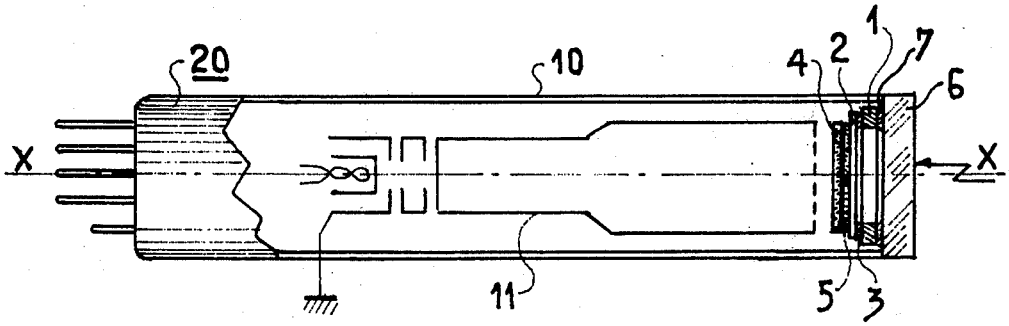
FIG. 2 is a cross-sectional view of an illustrative radiation detector according to the invention which employs the target assembly shown in FIG. 1.

FIG. 2 illustrates a section of a cylindrical camera tube with a pyro-electric target or retina according to FIG. 1. In this figure, there can be seen the insulating envelope 10 of the tube 20, made for example of glass, and closed off at the end at which the incident radiation (arrow) arrives by means of the front face 6 carrying retina 4. Inside the envelope there can be seen the electron-gun designated overall by the reference 11, which is entirely conventional. FIG. 2 does not illustrate the means conventionally associated with the tube in order to read out the signals at each point on the target during the scanning of the latter by the electron beam. These means are well known from the prior art.

One skilled in the art may make various changes and substitutions to the parts shown without departing from the spirit and scope of the invention.

What is claimed is:

1. A pyroelectric radiation detection device of the type that comprises an evacuated envelope having a window transparent to said radiation at one end thereof and, within said enevelope, a pyroelectric target proximate said window for receiving the radiation passing therethrough, characterized in that said device further comprises:

an annulus having a first natural period adhesively secured to said window;

a stretched support plate having a second natural period adhesively secured to said annulus, said first natural period being substantially greater than said second natural period and said annulus being at least two orders of magnitude thicker than said support plate; and means for securing said pyroelectric target to said support plate whereby said detection device is rendered relatively insensitive to microphonic vibration.

2. The detection device according to claim 1 characterized in that said annulus is comprised of metal and has a thickness in the order of 2 mm.

3. The detection device according to claim 2 characterized in that said support plate is comprised of mica and has a thickness of from about 3 to about 6 microns.

4. The detection device according to claim 3 characterized in that said stretched support plate is adhesively secured to said annulus by means of an enamel.

5. The detection device according to claim 1 characterized in that said target securing means comprises an oil having a relatively low vapour pressure.

6. The detection device according to claim 1 characterized in that said support plate is comprised of a polyester adhesively secured to said annulus by a plastic adhesive.

7. The detection device according to claim 1 characterized in that said annulus is comprised of titanium.

8. The detection device according to claim 1 characterized in that said annulus is comprised of a ferronickel.

* * * * *